US006767003B1

(12) United States Patent
Toensing

(10) Patent No.: US 6,767,003 B1
(45) Date of Patent: Jul. 27, 2004

(54) NAIL PULLING TOOL

(76) Inventor: James Toensing, 7930 S. Ash Ave., Tempe, AZ (US) 85284

( * ) Notice: Subject to any disclaimer, the term of this patent is extended or adjusted under 35 U.S.C. 154(b) by 0 days.

(21) Appl. No.: 10/357,704

(22) Filed: Feb. 3, 2003

(51) Int. Cl.[7] ..... B66F 15/00
(52) U.S. Cl. ..... 254/25
(58) Field of Search ..... 254/25, 21, 18, 254/28, 243, 131, 36; 29/267

(56) References Cited

U.S. PATENT DOCUMENTS 161,439 A * 3/1875 Ragan ..... 254/36
1,024,223 A * 4/1912 Pitre ..... 254/243
1,903,557 A * 4/1933 Swoyer ..... 254/25
5,984,272 A 11/1999 Crider
6,257,553 B1 7/2001 Khachatoorian

* cited by examiner

*Primary Examiner*—Robert C. Watson

(57) ABSTRACT

The invention described in this document is a device for pulling nails, specifically those used to secure concrete form boards to cylindrical stakes. In one embodiment the nail pulling device is composed of a handle, or handle attachment feature, that is either attached to, or integral with a saddle having a semi-circular, concave cross section that is swept at a constant radius, thereby, forming a circular segment of approximately 60°. The stake fits inside the semi-circular, concave cross section of the circular segment, which has a radius that is slightly larger than the radius of the stake for the purpose of maintaining the alignment between the device and the stake centerline. When the device is engaged with a nail and supported by a stake, the circular segment provides the extraction force to the nail head when the handle is lifted/pushed towards the stake.

4 Claims, 4 Drawing Sheets

NAIL PULLING TOOL

BACKGROUND OF THE INVENTION

1. Field of the Invention

This invention generally relates to mechanical tools, and more particularly to a tool for pulling nails from cylindrical stakes.

2. Description of the Prior Art

Stakes are used extensively in the concrete construction trade. The stakes are commonly cylindrical in shape and made from metal, although other materials like wood or plastic may be used. When concrete is poured, it is in a semi-liquid state and forms are required to constrain the concrete to a desired boundary. The stakes, which are driven into the ground with a sledgehammer, have pre-drilled holes passing through their body at a right angle to their central axis. It is the job of the workman when he drives the stake in the ground to orient the stake so that the pre-drilled holes are at right angles to the form. The form, is often a 2"×6" wooden plank. A nail, whose shank is of a smaller diameter than the pre-drilled hole in the stake and may utilize two heads on one end, is inserted into a hole in the stake and then driven into the form board. Nailing the form boards to the stakes ensures that the forms are held firmly in place while the concrete dries.

Once the concrete has hardened, the stakes must be pulled from the ground and the forms removed so finishing work may commence. Before this can happen, however, the nails securing the forms to the stakes must be removed. The currently-available tools, however, make such nail removal a very clumsy and time consuming task, primarily because of two factors. First, the close proximity of the nail to the ground limits the tool's operational space and its orientation to the stake. Second, it is difficult to locate and support a fulcrum point on a cylindrical stake.

A search for prior art found several examples of nail pulling implements. One example is U.S. Pat. No. 6,257,553 to Khachatoorian, dated Jul. 10, 2001, which depicts a device that relies on a fulcrum and lever arm to provide a mechanical advantage for easier nail extraction. This device, however, like the common claw hammer, which operates on a similar principle, does not lend itself well to removing nails from concrete form stakes due to the factors cited in the preceding paragraph. If the device is aligned parallel with the stake centerline during use, then, depending on whether the handle is located below or above the engaged nail, either the handle or the claw that grips the nail will likely come into contact with the ground. This is especially true of the claw hammer which seems to be the tool of choice in the large majority of cases. Thus, the ground would hinder the device's room to operate and impede its ability to remove the nail. If the nail is located close to the ground, which occurs frequently in the field due to the minimal height of the form boards, this inherent limitation of the device and of similar devices, which utilize the same fulcrum point and lever arm principle, can render the tool inoperative. Also, when the device is used in this vertical orientation, where the stake provides a suitable fulcrum point, the device is not stable and may slide off the stake if precise control is not used when operating the tool. This is because the surface of the device that contacts the stake at the fulcrum point does not match the cylindrical shape of the stake. Since contact occurs only along a thin line between the device and stake, the device lacks the ability to maintain its orientation, which to be effective must be in line with the stake central axis. If this orientation is not maintained the tool becomes unstable an often slips off the stake.

Reorienting the device so that it is parallel with the ground does not solve this problem and, in fact, introduces a different problem. Since the device is now perpendicular to the stake, the stake is unable to provide any support for the fulcrum point. Since the device cannot operate without a properly supported fulcrum point, the claw end of the tool must be rotated about the stake centerline until it comes into contact with the form board. The form board provides the required support to pull out the nail; however, when used in this manner the tool will not be able to pull the nail out straight. The nail shank will be bent around the sharp corner of the pre-drilled hole through the stake requiring extra effort by the operator of the tool. A better design would provide a well supported, stable fulcrum point by matching the cylindrical shape of the stake while eliminating the problem of interference caused by the ground and form board.

Another example of prior art is U.S. Pat. No. 5,984,272 to Crider, dated Nov. 16, 1999, which depicts a device with a slide hammer mechanism oriented inline with the nail's central axis, that has the ability to lock onto the nail head. This device relies upon the momentum transfer between the sliding hammer and the stop on the end of the shaft to pull out the nail. The main drawback to this approach is the amount of physical effort required by the operator of the tool. Since the device does not provide any mechanical advantage, the nail extraction is limited by the physical strength and stamina of the operator. A better approach would utilize a mechanical advantage to limit the force required by the user to extract the nail Also, pulling out the nail in one smooth motion, rather than several repeated hammer strokes, would minimize the amount of energy expended by the operator of the tool.

SUMMARY OF THE INVENTION

The invention described in this document is a device for pulling nails, specifically those used to secure concrete form boards to cylindrical stakes. In one embodiment the nail pulling device is composed of a handle, or handle attachment feature, that is either attached to, or integral with a saddle having a semi-circular, concave cross section that is swept at a constant radius, thereby, forming a circular segment of approximately 60°. The stake fits inside the semi-circular, concave cross section of the circular segment, which has a radius that is slightly larger than the radius of the stake for the purpose of maintaining the alignment between the device and the stake centerline. When the device is engaged with a nail and supported by a stake, the circular segment provides the extraction force to the nail head when the handle is lifted/pushed towards the stake.

The device interfaces with the nail head via a claw groove on the end of the saddle opposite where the handle is attached. The shape of the claw groove is not the typical long tapered vee used by most existing nail puller tools, particularly the claw hammer, but is rather short, with parallel sides. In order to facilitate the entry of the nail shank into the claw groove, the open end of the groove is bell shaped. The claw groove resides in a ledge that forms the top of the claw externally and the ceiling of a pocket internally. The pocket provides clearance for the nail head closest to the stake while an appropriate ledge thickness will ensure the absence of binding between the device and the nail heads. The external surface of the ledge remains flat for a short distance from the open end of the groove before curving outward at a gentle radius. The normal distance from the contact point between the device and stake, which acts as the active fulcrum point for the handle, to the flat portion of the external surface is slightly less than the distance from the stake to the outermost nail head, to ensure that the claw fits under the outermost nail head for the purpose of extraction. The outward curve of the external surface provides support for the second nail head as the nail is extracted.

In order to pull a nail from a stake, the operator may stand facing the stake with his feet planed approximately shoulder width apart. With the stake and nail head centered in front of him, the operator holds the invention by the handle with the claw groove pointing towards the ground. Next, the operator moves the device towards the slake until the stake fits inside the concave contour of the circular segment. At this point the handle will be at an angle of approximately 60° to the stake with the claw groove roughly a couple of inches above the nail head. The operator then slides the device down the stake so that the nail head is admitted into the claw groove. When the nail head bottoms out against the outward curving surface of the claw the operator will begin to swing the handle upwards towards the stake while maintaining a small amount of downward pressure. The downward pressure causes the fit point of the device to slide down the stake, which forces the nail head to climb the gentle outward curve on the external surface of the claw ledge. This ensures that the nail will not be bent during the exaction process since the orientation of the extraction force exerted on the nail head by the device remains essentially normal to the stake and parallel with the centerline of the nail.

When the handle has been swung into a vertical position the nail will be completely pulled out of the form board but will still be resting loosely inside the pre-drilled hole through the stake. The operator will then simply move the device away from the stake, carrying the nail with it, to complete the nail extraction operation. Thus, the entire process of pulling the nail is accomplished in one fluid motion with the operator remaining in an upright position, greatly increasing worker comfort and efficiency.

BRIEF DESCRIPTION OF THE DRAWINGS

The following drawings provide a better understanding of particular embodiments of the invention.

DETAILED DESCRIPTION OF THE INVENTION

Figure 13:
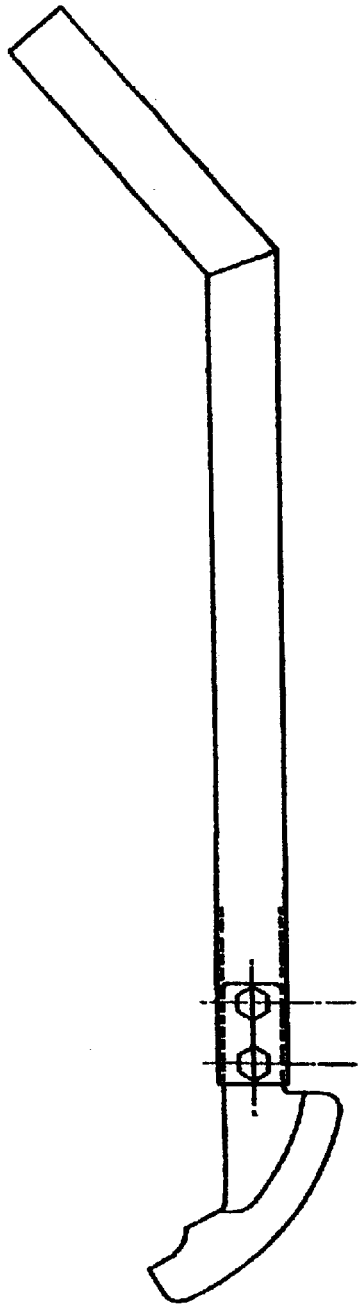
FIG. 13 is an orthogonal side view of one embodiment of the invention depicting a nail puller attached to a non-integral handle.
Figure 14:
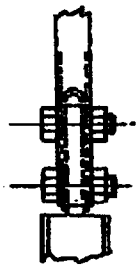
FIG. 14 is an orthogonal end view of FIG. 13 depicting the handle mounting details of one embodiment of the invention.

The constituent parts of the invention are labeled in FIG. 1 through FIG. 5. A cylindrical stake fits loosely inside a saddle 1. The saddle 1 is comprised of a semi-circular, concave cross section 3 having a constant radius and forming a circular segment of approximately 60°. Affixed to the saddle 1 is a handle 2, one embodiment of which is shown in FIG. 13 and FIG. 14, that serves as the invention's interface with the operator. On the end of the saddle 1 opposite the handle 2 is a claw groove 5. The claw groove 5 may be rather short with parallel sides, and may have a bell shaped entry 7 to facilitate the admission of a nail shank into the claw groove 5. The claw groove 5 exists within a ledge 4 that forms the top of the claw groove 5 externally and the ceiling of a pocket 6 internally.

The individual components identified above perform several tasks that allow the invention to smoothly and effortlessly pull nails from cylindrical stakes. The saddle 1 with its semi-circular, concave cross section 3 performs at least three such tasks. First, it keeps the invention aligned with the stake centerline so that the nail head can accurately slide into the claw groove 5. Second, it provides a fulcrum point 8 where the cross section 3 contacts the surface of the stake. Since the distance between the fulcrum point 8 and the end of the handle 2 is greater than the distance between the fulcrum point 8 and the ledge 4, which interfaces with the nail head, a force amplification is realized. This mechanical advantage reduces the amount of energy expended by the operator while pulling the nail. Third, it preserves the alignment of the concave cross section 3 with the stake centerline so that fulcrum point 8 maintains its maximum advantage without slipping off the stake.

The claw groove 5 and its associated components have several features that further enhance the utility of the invention. Clearance for the first nail head, which rests against the stake when double-headed nails are used, is provided by the pocket 6 that sits between the claw groove 5 and the stake. The top of the pocket 6, which corresponds with the underside of ledge 4, has a curved shape that, together with an appropriate ledge 4 thickness, will prevent binding between the invention and the two nail heads as the nail is pulled out and the nail shank moves further into the claw groove 5. The external surface of ledge 4 remains flat for a short distance from the groove's bell shaped entry 7 before curving outward at surface 9. The normal distance from the fulcrum point 8 to the flat portion of the external surface of ledge 4 is slightly less than the distance between of the second nail head and the stake, to ensure that the claw groove 5 fits under the second nail head for the purpose of extraction. The outward curving 9 of the external surface of ledge 4 provides support for the second nail head as the geometry of the surface of ledge 4 changes with respect to the stake centerline during the rotating action of the invention as depicted FIG. 7 through FIG. 12. Due to the weight of the nail and the loose fit that exits between the nail shank and claw groove 5, the nail will simply fall out of the claw groove 5 when the nail has been fully extracted. The invention will then be ready to pull another nail.

Figure 1:
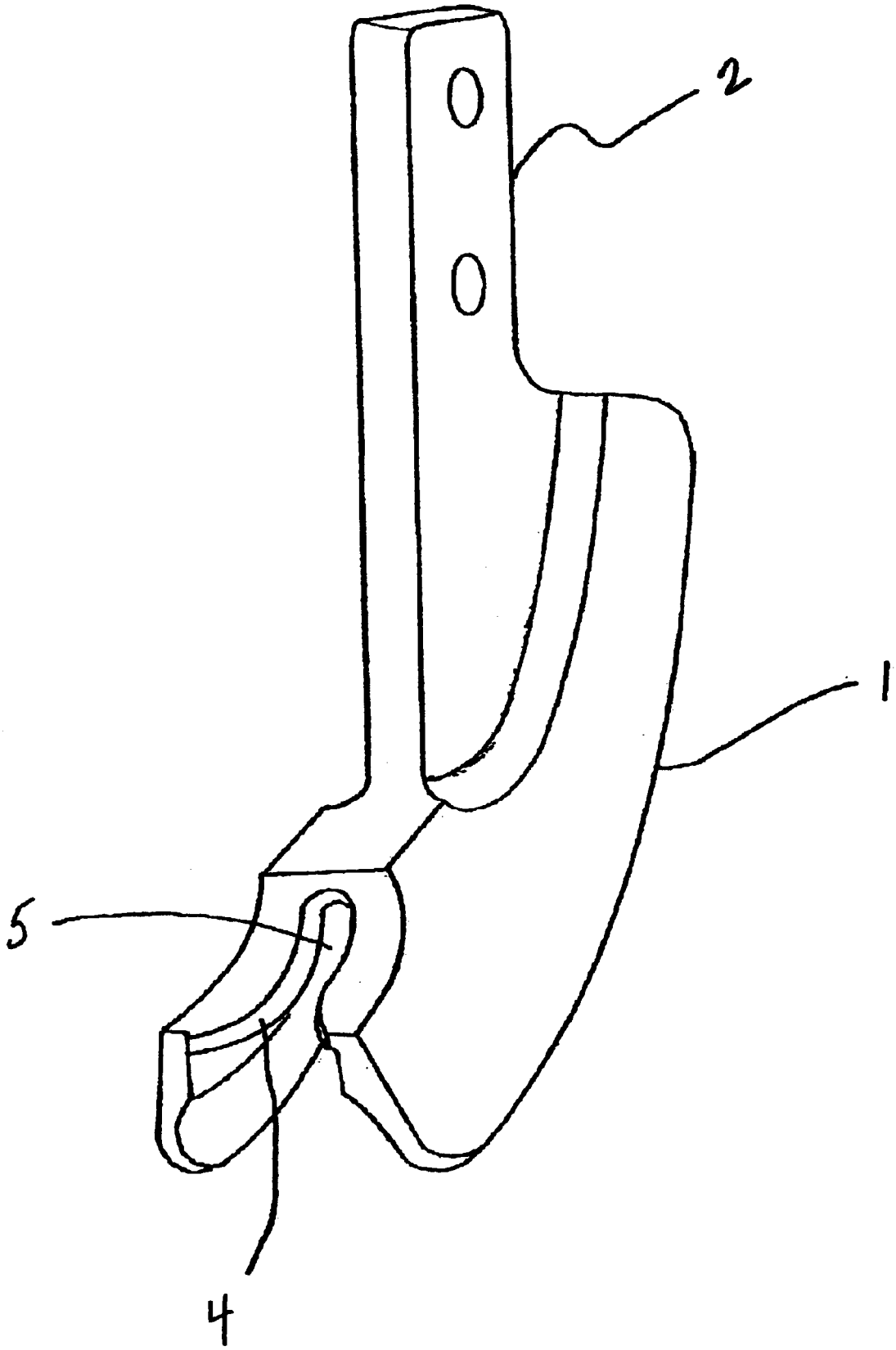
FIG. 1 is an isometric view that identifies the major components of one embodiment of the invention.
Figure 2:
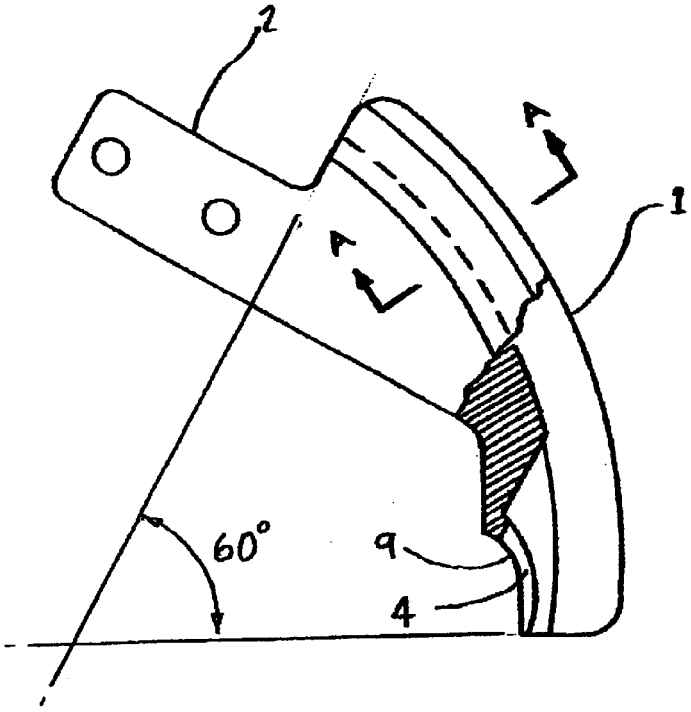
FIG. 2 is an orthogonal side view of one embodiment of the invention.
Figure 4:
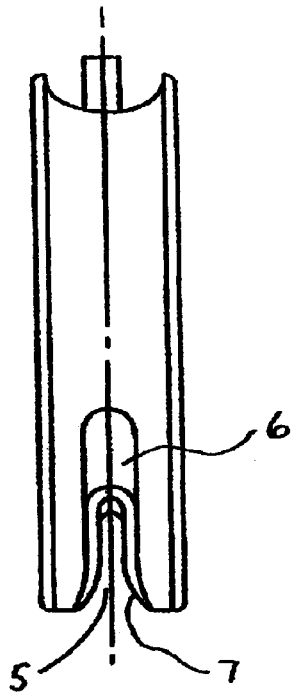
FIG. 4 is an orthogonal view depicting the saddle that faces the stake.
Figure 3:
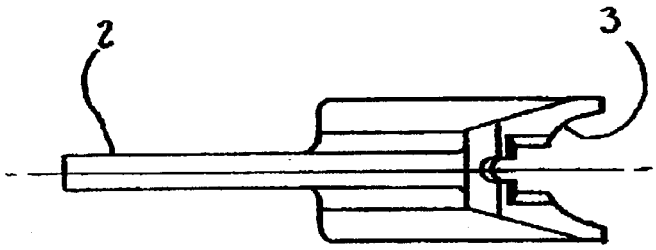
FIG. 3 is an orthogonal view looking at the end of one embodiment of the invention containing the claw groove.
Figure 5:
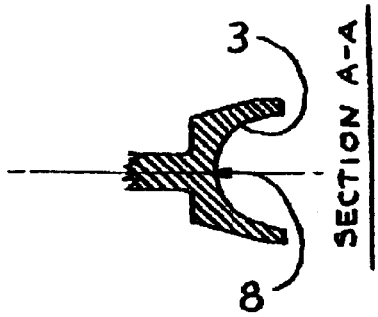
FIG. 5 is a cross-sectional view of the saddle.
Figure 6:
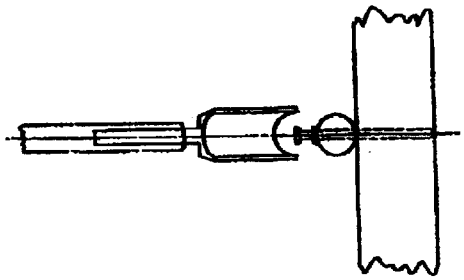
FIG. 6 is a view looking down the axis of a stake depicting one embodiment of the invention just before it engages a double headed nail securing a cylindrical stake to a form board. This is also the projection of FIG. 7.
Figure 7:
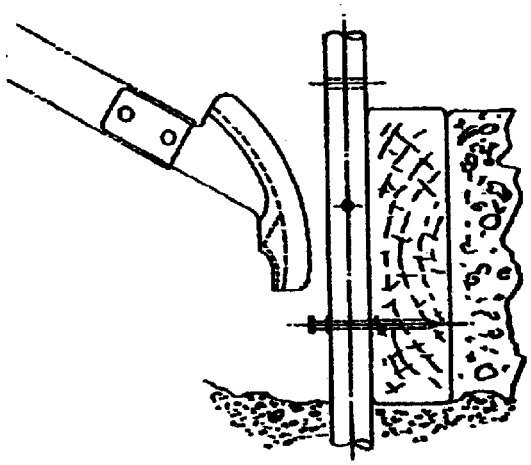
FIG. 7 to FIG. 12 are a series of illustrations depicting the sequence of steps required for one embodiment of the invention to pull out a nail that is securing a cylindrical stake to a form board. Arrows describing the motion of the invention relative to the stake during these steps are provided to further illuminate the process.
Figure 8:
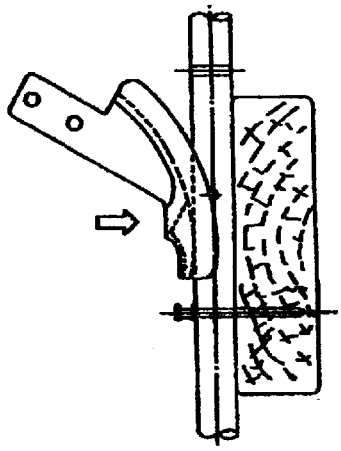
Figure 9:
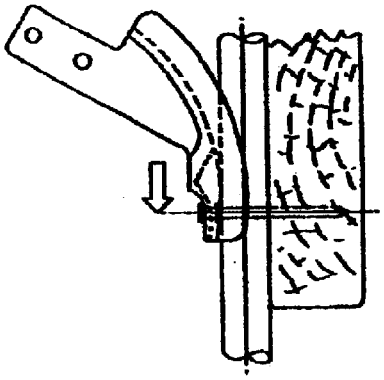
Figure 10:
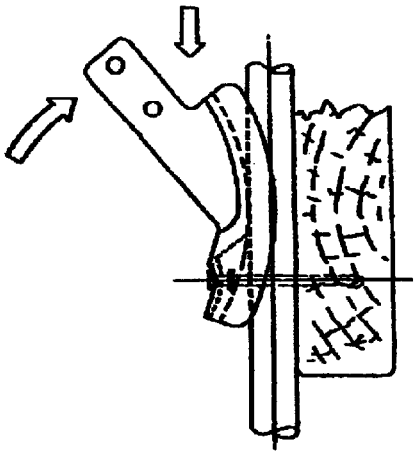
Figure 11:
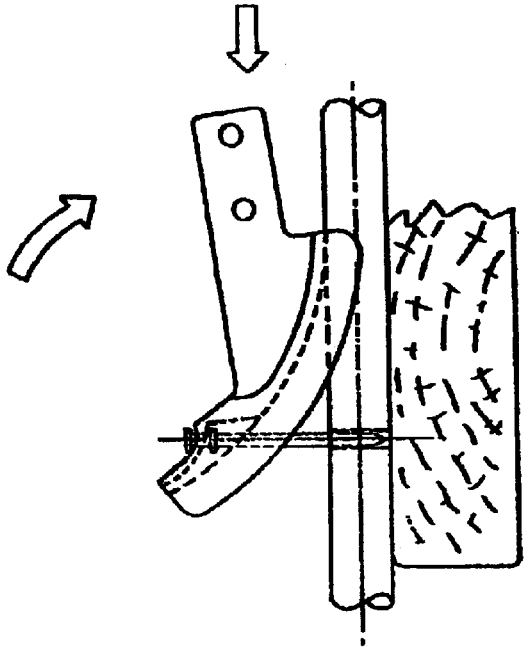
Figure 12:
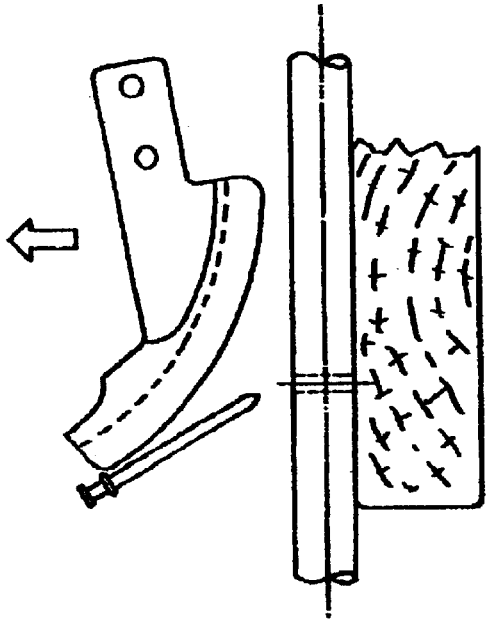

The process of using the invention to pull out a nail that is securing a cylindrical stake to a form board is depicted in FIG. 7 through FIG. 12. Initially, the operator stand facing the stake. With the stake and nail head in front of him, the operator, using either one or both of his hands, holds the tool by the handle 2 with the claw groove 5 pointing towards the ground. The handle 2 will be at an angle of approximately 60° to the stake with the claw groove 5 located a couple of inches in front of the stake and above the nail head as shown in FIG. 6 and FIG. 7. Next, the operator will advance the tool towards the stake until the stake fits inside and makes contact with the concave cross section 3 as shown in FIG. 8. The operator then slides the tool down the stake so that the nail head passes through the bell shaped entry 7 and is admitted into the claw groove 5 as shown in FIG. 9. When the nail head bottoms out against the outward curving surface 9 of claw groove 5 the tool is fully engaged with the nail To extract the nail the operator will begin to swing the handle 2 upwards towards the stake while maintaining a small amount of downward pressure. This step is portrayed in FIG. 10. The downward pressure causes the fulcrum point 8 to slide down the stake, which forces the nail head to climb the surface 9 on the external surface of the ledge 4. This ensures that the nail will not be bent during the extraction process since the orientation of the extraction force exerted on the nail head by the tool remains normal to the stake and parallel with the centerline of the nail. The operator continues this process until the handle 2 has been swung into a near vertical position as shown in FIG. 11. At this point the nail will be completely pulled out of the form board but will still be resting loosely inside the pre-drilled hole in the stake. The operator will then simply move the tool away from the stake in a direction parallel with the nail's centerline to complete the nail extraction operation. Once the nail shank has cleared the hole through the stake, the nail will simply slip out of the claw groove 5 and fall to the ground. This final step is shown in FIG. 12.

The description and drawings describing the invention merely serve as one example of the invention's many forms. As previously stated, the handle 2 may take several forms to allow for the most efficient interface with the operator. For example, the arm of the handle 2 may be replaced by an attachment feature that allows the invention to connect to another tool thus forming a multipurpose tool that further enhances productivity. Another alternate form would allow the invention to be used with a variety of different types of nails by modifying the width and length of the claw groove 5, the thickness of the claw ledge 4, or other geometric parameters consistent with this document. Several other modifications and variations may be made to the invention's design and construction without departing from the scope of the invention as described in this document and following claims.

What I claim as my invention is:

1. A nail-pulling tool comprising:

a handle;

a saddle coupled to the handle and comprising a concave surface opposite the handle; and a claw groove extending through the saddle, wherein:

the claw groove is configured to receive at least a portion of a nail; and the concave surface is configured to receive at least a portion of a cylindrical stake and the claw groove has a bell shaped opening.

2. The nail-pulling tool as set forth in claim 1, further comprising: a ledge adjacent to the claw groove; and a pocket between the claw groove and the concave surface, the pocket having a ceiling, wherein: the ceiling of the pocket forms an underside of the ledge; and the ledge comprises an external surface having a flat portion adjacent to the bell shaped opening, and a curved portion adjacent to the flat portion.

3. The nail-pulling tool as set forth in claim 1, wherein: the claw groove has sides that are substantially parallel; and the sides are separated by a separation distance.

4. The nail-pulling tool as set forth in claim 3, wherein the separation distance is greater than approximately 0.16 inch.

* * * * *